US009196955B2

(12) United States Patent
Higaki et al.

(10) Patent No.: US 9,196,955 B2
(45) Date of Patent: Nov. 24, 2015

(54) ANTENNA DEVICE

(71) Applicants: Makoto Higaki, Tokyo (JP); Masaki Nishio, Yokohama (JP); Ippei Kashiwagi, Tokyo (JP)

(72) Inventors: Makoto Higaki, Tokyo (JP); Masaki Nishio, Yokohama (JP); Ippei Kashiwagi, Tokyo (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 219 days.

(21) Appl. No.: 13/707,876

(22) Filed: Dec. 7, 2012

(65) Prior Publication Data

US 2013/0249769 A1 Sep. 26, 2013

(30) Foreign Application Priority Data

Mar. 26, 2012 (JP) ..... 2012-069684

(51) Int. Cl.

| | |
|---|---|
| ***H01Q 1/50*** | (2006.01) |
| ***H01Q 3/24*** | (2006.01) |
| ***H01Q 9/42*** | (2006.01) |
| ***H01Q 21/26*** | (2006.01) |

(52) U.S. Cl.

CPC . *H01Q 1/50* (2013.01); *H01Q 3/24* (2013.01); *H01Q 9/42* (2013.01); *H01Q 21/26* (2013.01)

(58) Field of Classification Search

CPC ..... H01Q 21/26; H01Q 3/24; H01Q 9/42; H01Q 1/50

See application file for complete search history.

(56) References Cited

U.S. PATENT DOCUMENTS

| | | | | |
|---|---|---|---|---|
| 6,407,718 | B2 * | 6/2002 | Adachi et al. | 343/878 |
| 7,411,560 | B2 * | 8/2008 | Jordan | 343/725 |
| 7,821,461 | B2 * | 10/2010 | Lai et al. | 343/700 MS |
| 2005/0237258 | A1 * | 10/2005 | Abramov et al. | 343/834 |
| 2008/0174508 | A1 * | 7/2008 | Iwai et al. | 343/850 |
| 2010/0117922 | A1 * | 5/2010 | Fukuda | 343/876 |

FOREIGN PATENT DOCUMENTS

| | | | | |
|---|---|---|---|---|
| JP | 2001-024431 | A | 1/2001 | |
| JP | 2006005645 | A | 1/2006 | |
| JP | 2006005645 | * | 5/2006 | H01Q 1/50 |
| JP | 2006352659 | A | 12/2006 | |
| JP | 2009124582 | A | 6/2009 | |
| JP | 2010232820 | A | 10/2010 | |

OTHER PUBLICATIONS

Japanese Office Action dated Jul. 18, 2014 in counterpart Japanese Application No. 2012-069684.

* cited by examiner

*Primary Examiner* — Trinh Dinh

(74) *Attorney, Agent, or Firm* — Holtz, Holtz, Goodman & Chick PC

(57) ABSTRACT

There is provided an antenna device including: a finite ground plane; a feeding point; feed antenna elements arranged in a radial fashion around the feeding point at a height from the finite ground plane; a selector switch to connect a first end of a feed antenna element selected from the feed antenna elements to the feeding point; and parasitic elements arranged correspondingly to the feed antenna elements, in which a first end thereof is connected to the finite ground plane and a portion including a second end thereof is capacitively coupled with the feed antenna element corresponding thereto, wherein a first length of the parasitic element is approximately a quarter of a wavelength of a radio frequency to be used, and a length from the second end of the feed antenna element to the feeding point is shorter than the first length of the parasitic element.

14 Claims, 4 Drawing Sheets

ANTENNA DEVICE

CROSS REFERENCE TO RELATED APPLICATIONS

This application is based upon and claims the benefit of priority from the prior Japanese Patent Application No. 2012-069684, filed on Mar. 26, 2012, the entire contents of which are incorporated herein by reference.

FIELD

Embodiments described herein relate to an antenna device, and to a configuration of a variable radiation directivity antenna, for example.

BACKGROUND

There is conventionally proposed an antenna device that has a configuration in which a plurality of parasitic elements with one ends respectively connected to variable reactance elements are arranged around a feed monopole antenna on a ground plane.

In the above-described antenna device, because the variable reactance element is used for each of the plurality of parasitic elements arranged around the feed monopole antenna, there is a problem that the number of components increases thereby to increase cost.

DETAILED DESCRIPTION

According to some embodiments, there is provided an antenna device including: a finite ground plane, a feeding point, a plurality of feed antenna elements, a selector switch and a plurality of parasitic elements.

The feeding point is provided on the finite ground plane. The feed antenna elements are arranged in a radial fashion around the feeding point at a height from the finite ground plane.

The selector switch connects a first end of a feed antenna element selected from the plurality of feed antenna elements to the feeding point.

The plurality of parasitic elements are arranged correspondingly to the feed antenna elements, in which first ends of the parasitic elements are connected to the finite ground plane, and portions including second ends of the parasitic elements are capacitively coupled with the feed antenna elements corresponding to the parasitic elements.

A first length of each parasitic element is approximately a quarter of a wavelength of a radio frequency to be used, and A length from the second end of each feed antenna element to the feeding point is shorter than a first length of each parasitic element.

Hereinafter, embodiments will be described in detail with reference to the drawings.

Figure 1:
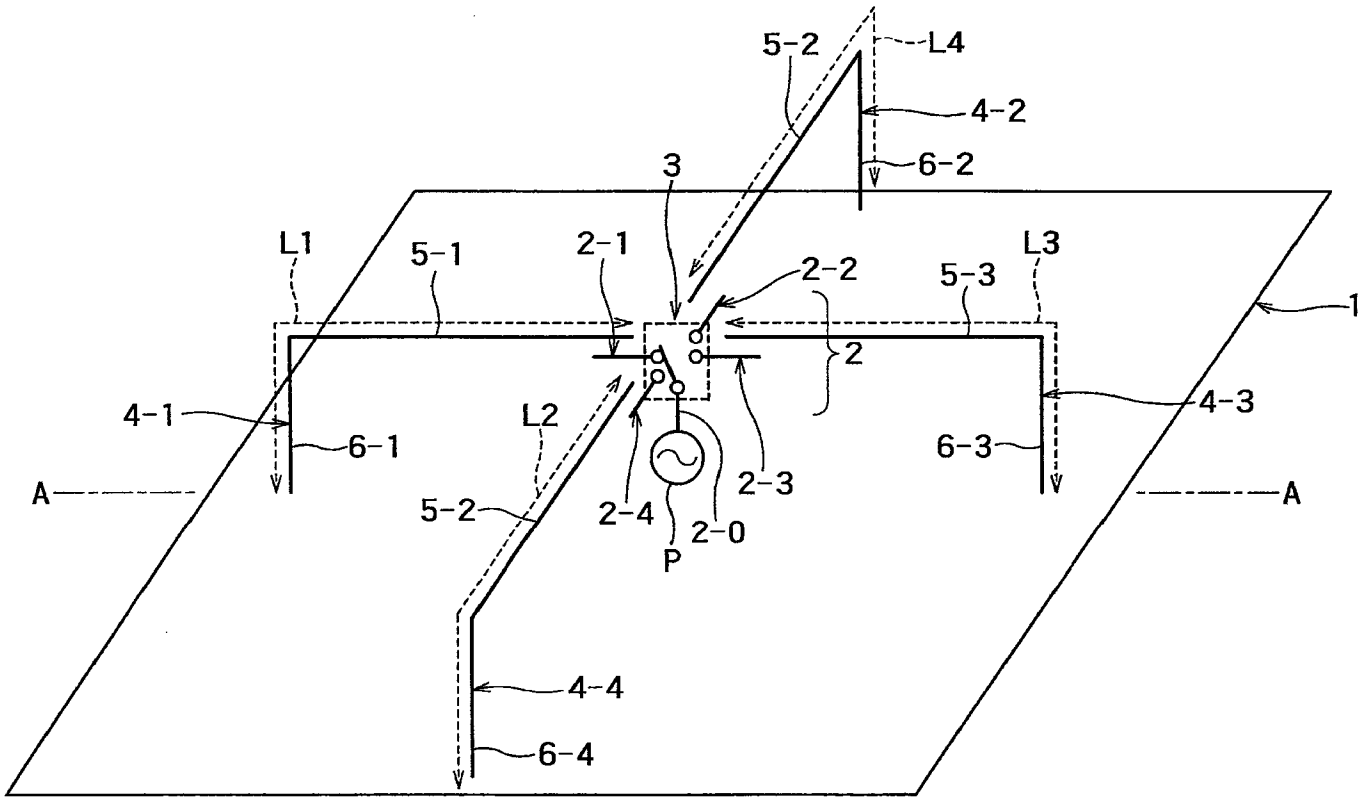
FIG. 1 is a diagram of an antenna device according to a first embodiment.
Figure 2:
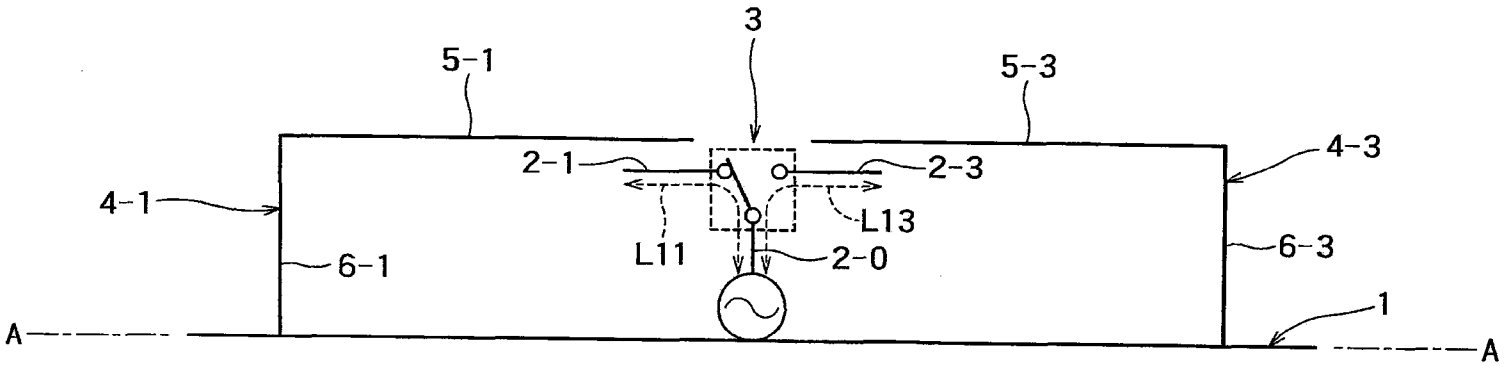
FIG. 2 is a cross-sectional diagram of the antenna device illustrated in FIG. 1.

FIG. 1 is a diagram of an antenna device according to a first embodiment. FIG. 2 is a cross-sectional diagram taken along a plane including parasitic elements 4-1, 4-3 of the antenna device illustrated in FIG. 1. A cross-sectional diagram taken along a plane including parasitic elements 4-2 and 4-4 is identical to FIG. 2, and therefore not shown.

The antenna device illustrated in FIG. 1 includes a finite ground plane 1, a feeding point P arranged on the finite ground plane 1, a feed antenna 2 (2-0, 2-1, 2-2, 2-3 and 2-4), a selector switch 3 and parasitic elements 4-1, 4-2, 4-3 and 4-4.

The conductive element (feeder wire) 2-0 of the feed antenna 2*a* is a linear element, in which one end of the conductive element 2-0 is connected to the feeding point P and the other end is directed to a direction perpendicular to the ground plane.

Four branches (feed antenna elements) 2-1, 2-2, 2-3 and 2-4 are linear conductive elements each arranged at a predetermined height (distance) from a surface of the finite ground plane 1. Each of the branches is arranged in parallel with the finite ground plane 1 and the branches are arranged in a radial fashion centering around the feeding point P. In the present embodiment, the branches are arranged at a distance approximately equal to each other (in the illustrated embodiment, approximately at a 90 degree distance when viewed from above). When viewed from the feeding point P side, the other end of the conductive element 2-0 seems to branch into four branches 2-1, 2-2, 2-3 and 2-4. In the present embodiment, each branch is a linear element but may be a planar element.

A length of each feed antenna element (see lengths L11 and L13 of feed antenna elements 2-1 and 2-3 in FIG. 2), more particularly, each electrical length including the conductive element 2-0 from the other end (open end) of the feed antenna element to the feeding point P is less than a quarter of a wavelength corresponding to a radio frequency to be used.

The selector switch 3 is a multistage high frequency switch that electrically switches to connect the other end of the conductive element 2-0 to one end of any selected one of the branches. Practically, as the selector switch 3, a PIN (P-intrinsic-N) diode switch, a FET (Field Effect Transistor) switch, a MEMS (Micro Electro Mechanical System) switch and the like are used. Which branch is selected is determined depending on a control signal from outside.

The parasitic elements 4-1, 4-2, 4-3 and 4-4 are inversed-L conductive elements and each one end is connected to the finite ground plane 1. More particularly, the parasitic elements 4-1, 4-2, 4-3 and 4-4 include conductive elements 5-1, 5-2, 5-3 and 5-4 parallel to the ground plane 1 and conductive elements 6-1, 6-2, 6-3 and 6-4 connecting respective one end of the conductive elements 5-1, 5-2, 5-3 and 5-4 to the ground plane 1. In the present embodiment, the conductive elements are linear elements but may be planar elements. In this case, surfaces of the planar elements corresponding to the conductive elements 5-1, 5-2, 5-3 and 5-4 may be either parallel to or perpendicular to the finite ground plane 1. Further, the parasitic elements 4-1, 4-2, 4-3 and 4-4 may be meander-shaped.

The conductive elements 5-1, 5-2, 5-3 and 5-4 are arranged in parallel with and closely to the conductive elements 2-1, 2-2, 2-3 and 2-4 with each other at a height higher than that of the conductive elements 2-1, 2-2, 2-3 and 2-4. When viewed from above, the conductive elements 5-1, 5-2, 5-3 and 5-4 and the conductive elements 2-1, 2-2, 2-3 and 2-4 partially overlap with each other.

Note that, the case is one example and the present embodiment is not limited to this case. For example, when viewed from above, the conductive elements 5-1, 5-2, 5-3 and 5-4 may be arranged in alignment with the conductive elements 2-1, 2-2, 2-3 and 2-4 such that the one ends of the conductive elements 5-1, 5-2, 5-3 and 5-4 face the other ends of the conductive elements 2-1, 2-2, 2-3 and 2-4, respectively. Note that, though design flexibility is decreased and utility is spoiled in this case, this arrangement has potential to be adopted in the case where large size of device is acceptable. Further, the conductive elements 5-1, 5-2, 5-3 and 5-4 may be arranged in such a manner as not to overlap the conductive elements 2-1, 2-2, 2-3 and 2-4 when viewed from above, at a distance from the conductive elements 2-1, 2-2, 2-3 and 2-4. In this case, the conductive elements 5-1, 5-2, 5-3 and 5-4 may be arranged at a height the same as that of the conductive elements 2-1, 2-2, 2-3 and 2-4.

Each of the parasitic elements 4-1, 4-2, 4-3 and 4-4 has a length (L1, L2, L3, and L4, respectively) of approximately a quarter of a wavelength λ corresponding to the radio frequency to be used. The electrical length of the feed antenna element from the open end to the feeding point is shorter than a quarter of the wavelength and shorter than the parasitic element as described above.

A portion on the open end side of the parasitic elements 4-1, 4-2, 4-3 and 4-4 and a portion on the open end side of the feed antenna (the other end side of the branches 2-1, 2-2, 2-3 and 2-4) are adjacent to each other one-on-one as describe above thereby to form capacitive coupling.

It is preferred that a distance between each of the parasitic elements and each of the branches for forming the capacitive coupling is one tenth or less of the wavelength λ. It is because when the distance is one tenth or less of the wavelength, coupling of charges at tips by electrostatic field is stronger than other couplings (induced field+radiation field). Accordingly, as is described below, more current flows in the parasitic element than the feed antenna during operation and intended radiation property can be achieved.

With the above-described configuration, the radiation directivity of the antenna can be changed. Hereinafter, the operation of the antenna device will be described.

A radio signal fed from the feeding point P to the feed antenna 2 flows as a high frequency current to one branch selected by the selector switch 3 and capacitively couples with the parasitic element among the parasitic elements 4-1, 4-2, 4-3 and 4-4 which is close to the one branch. Thereby, the high frequency current flows to the capacitively-coupled parasitic element.

At this time, because the parasitic element has a total length of a quarter of the wavelength λ, corresponding to the radio frequency, the parasitic element resonates stronger than the feed antenna element having a shorter total length. As a result, the high frequency current principally flows to the parasitic element side. Accordingly, because when the selector switch 3 is switched, the parasitic element to which the high frequency current flows is also switched, the radiation directivity can be changed. Because a ground point of each parasitic element can be arranged at a physically distant location each other, the radiation pattern can be greatly changed though a single switch is used.

Further, by significantly differentiating a length of the feed antenna element from a length of the parasitic element and reducing a current flowing to the feed antenna element, the radiation directivity can be more greatly changed. Accordingly, even in the case that a mounting space is small, the antenna having variable radiation directivity can be easily mounted.

Still further, because the size of the ground plane is finite, the radiation directivity is influenced by a current flowing through the finite ground plane 1. Because the parasite element in which the high frequency current flows is switched, a current direction on the finite ground plane changes. As a result, even the radiation directivity caused by the current on the finite ground plane can be greatly changed.

Still further, because only a single packaged multistage selector switch 3 is used as the variable element in the present embodiment, cost can be reduced with less number of components in comparison with related art. That is, it is not necessary to arrange a variable reactance element for each parasitic element as in the related art.

Figure 3:
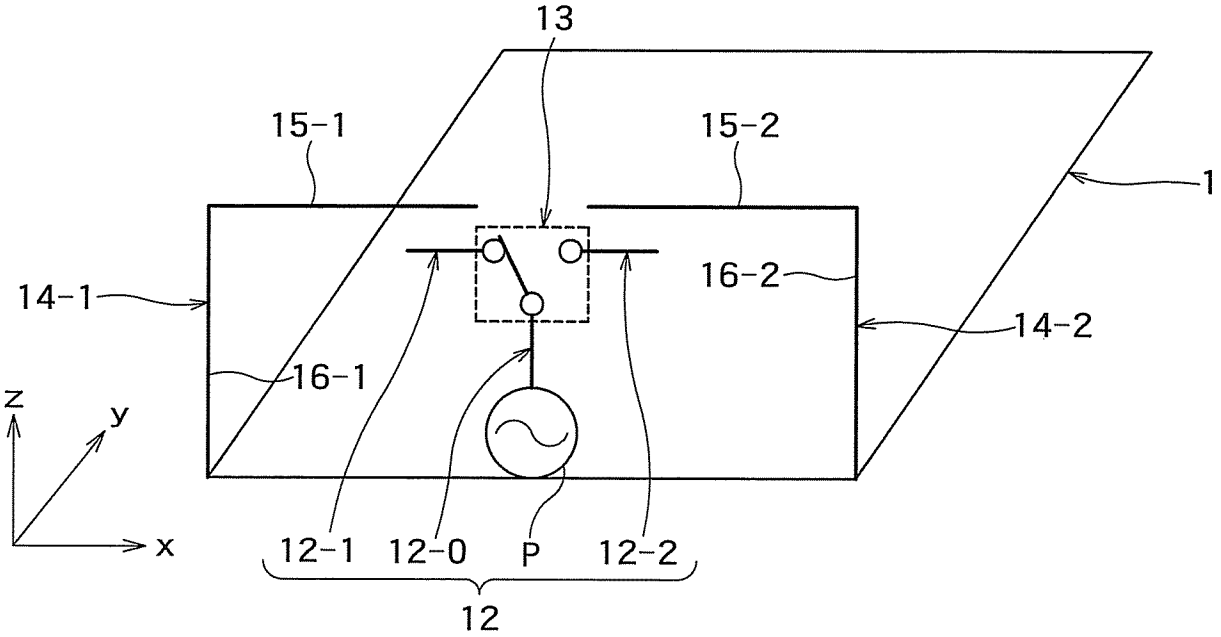
FIG. 3 is a diagram of an antenna device according to a second embodiment.

FIG. 3 is a diagram of an antenna device according to a second embodiment. An antenna device illustrated in FIG. 3 includes a finite ground plane 1, a feeding point P, a feed antenna 12 (12-0, 12-1 and 12-2), a selector switch 13 and parasitic elements 14-1 (15-1 and 16-1) and 14-2 (15-2 and 16-2).

Unlike the first embodiment, the feeding point P is arranged on a side of the ground plane. And the feed antenna 12 has a shape branched into two branches when viewed from the feeding point P side. That is, the number of branches of the feed antenna 12 is two (12-1 and 12-2). Other configurations are basically similar to those in the first embodiment.

One ends of the parasitic elements 14-1 and 14-2 are connected with the corners of the rectangular finite ground plane 1, respectively. Each of conductive elements 15-1 and 15-2 of the parasitic elements 14-1 and 14-2 is parallel with a side of the finite ground plane 1. Other configurations are similar to those of the parasitic elements in the first embodiment.

Other components are similar to those described in the first embodiment and therefore description is omitted.

With the above-described configuration, the radiation directivity of the antenna can be changed. Hereinafter, the operation of the antenna device will be described.

Like the case in the first embodiment, by switching the selector switch 13, the parasitic element through which the high frequency current flows is switched to cause the radiation directivity to change.

In addition, because the parasitic elements are connected to the corners of the finite ground plane, the high frequency current on the finite ground plane is switched to flow in two diagonal directions of the finite ground plane 1, thereby changing the radiation directivity greatly. Accordingly, the radiation directivity can be greatly changed even in a state where a height (length of each of the conductive elements 16-1 and 16-2) in a direction perpendicular to the finite ground plane 1 of the parasitic element becomes small and due to this, the radiation directivity is hard to be changed even though switching the parasitic element through which the high frequency current flows.

That is, in the case where a height (a length of each of the conductive elements 16-1 and 16-2) in a direction perpendicular to the finite ground plane 1 of the parasitic element is small, the conductive elements 16-1 and 16-2 contribute to radiation becomes smaller. Further, current components of the conductive elements 15-1 and 15-2 and a current flowing through the ground plane cancel each other out, so that contribution to radiation becomes smaller. However, in the present embodiment, by connecting the parasitic elements to the corners of the finite ground plane, the current flowing in the finite ground plane can be switched between diagonal directions thereby changing the radiation directivity greatly.

Note that, because only a single selector switch is required, cost can be reduced with less number of components, as in the case of the first embodiment.

Figure 4:
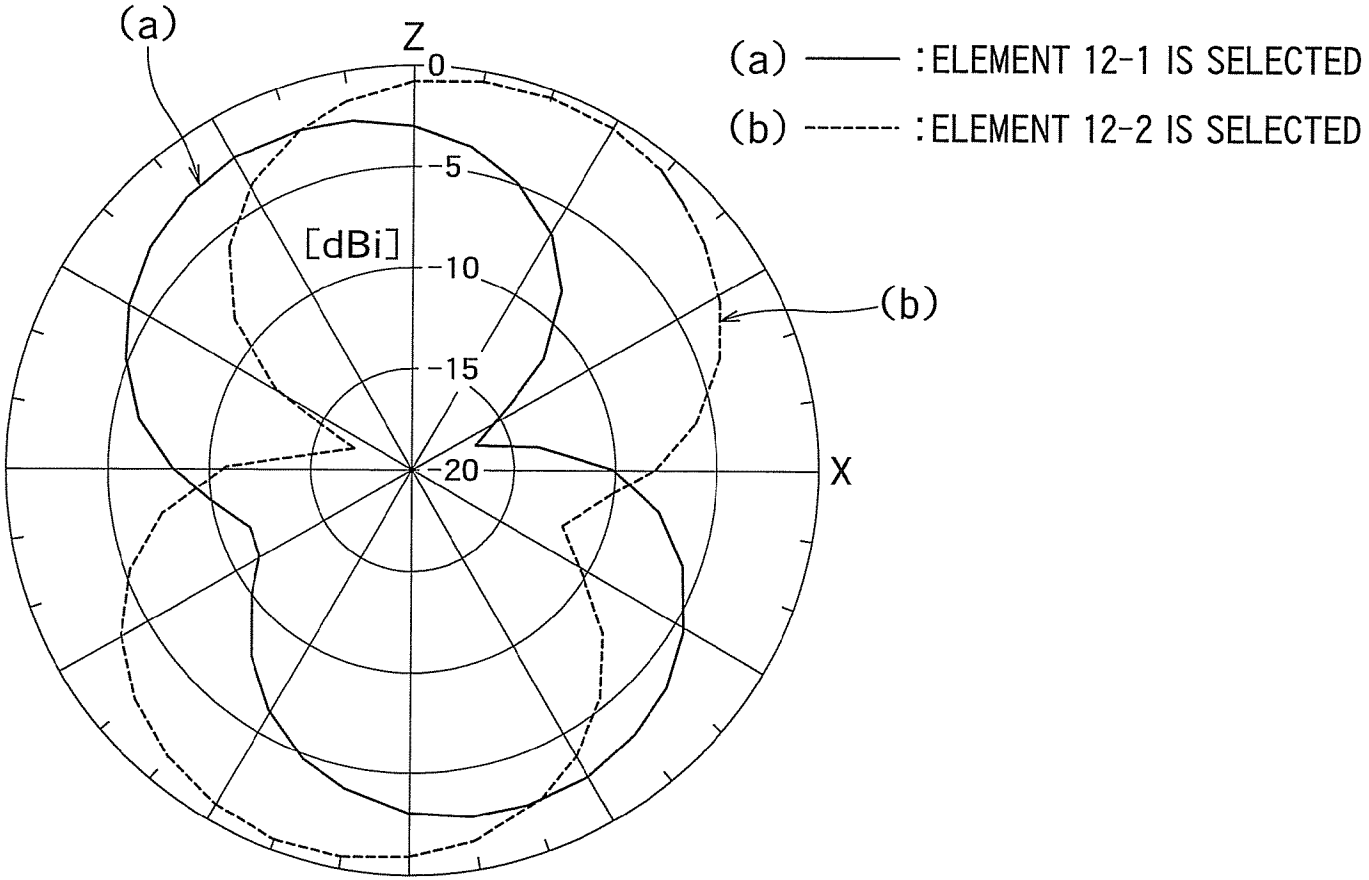
FIG. 4 is a diagram that illustrates one example of radiation directivity obtained by the antenna device according to the second embodiment.

FIG. 4 illustrates radiation directivity in zx plane when the antenna illustrated in FIG. 3 is analyzed. Definition of the coordinate is illustrated in FIG. 3. A solid line represents the case where the switch selects the branch 12-1 of the antenna in FIG. 3, and a dotted line represents the case where the switch selects the branch 12-2 of the antenna in FIG. 3. As illustrated in FIG. 4, radiation directivity biased to the selected parasitic element side is produced with respect to +z direction perpendicular to the finite ground plane 1, it can be seen that radiation directivity can be greatly changed.

Though in the above-described first embodiment, four parasitic elements are used, and in the second embodiment, two parasitic elements are used, the number of parasitic elements is not limited to and may be any number more than one.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. An antenna device comprising:

a finite ground plane;

a feeding point provided on the finite ground plane;

a plurality of feed antenna elements radially arranged around the feeding point at a height from the finite ground plane;

a selector switch to connect a first end of a feed antenna element selected from the plurality of feed antenna elements to the feeding point; and a plurality of parasitic elements arranged correspondingly to the feed antenna elements, wherein first ends of the parasitic elements are connected to the finite ground plane, and portions including second ends of the parasitic elements are capacitively coupled with the feed antenna elements corresponding to the parasitic elements, wherein a length of each parasitic element is approximately a quarter of a wavelength of a radio frequency to be used, wherein a length from a second end of each feed antenna element to the feeding point is shorter than the length of each parasitic element, and wherein the finite ground plane has a rectangular shape, the first ends of the parasitic elements are connected to corners of the finite ground plane, respectively, and none of the parasitic elements is provided with a switch.

2. The antenna device according to claim 1, wherein a distance between each feed antenna element and one of the parasitic elements corresponding thereto is equal to or less than one tenth of the wavelength of the radio frequency to be used.

3. The antenna device according to claim 1, wherein each of the parasitic elements is an inverted-L element.

4. The antenna device according to claim 3, wherein:

each of the parasitic elements includes a first conductive element parallel to the finite ground plane and a second conductive element, a first end of the second conductive element being connected to one end of the first conductive element, and a second end of the second conductive element being connected to the finite ground plane, each of the feed antenna elements corresponding to respective ones of the parasitic elements is parallel to the finite ground plane, and the first conductive element of each of the parasitic elements is arranged at a higher height than a height of each of the feed antenna elements.

5. The antenna device according to claim 1, wherein the first ends of two parasitic elements are connected to respective adjacent corners of the finite ground plane, and the feeding point is arranged between the respective adjacent corners in the finite ground plane.

6. The antenna device according to claim 1, wherein the selector switch selects the feed antenna element from the feed antenna elements according to an externally-provided control signal.

7. The antenna device according to claim 1, wherein the feed antenna elements are arranged apart from each other at substantially equal intervals.

8. The antenna device according to claim 1, wherein each of the feed antenna elements includes a linear-shaped conductive element.

9. The antenna device according to claim 1, wherein each of the feed antenna elements includes a plate-shaped conductive element.

10. The antenna device according to claim 1, wherein each of the parasitic elements includes a linear-shaped conductive element.

11. The antenna device according to claim 1, wherein each of the parasitic elements includes a plate-shaped conductive element.

12. The antenna device according to claim 1, wherein each of the parasitic elements includes a meander-shaped conductive element.

13. The antenna device according to claim 1, wherein the selector switch includes a PIN (P-intrinsic-N) diode switch, a FET (Field Effect Transistor) switch, or a MEMS (Micro Electro Mechanical System) switch.

14. The antenna device according to claim 1, wherein the first ends of the parasitic elements are connected to respective outermost corners of the finite ground plane.

* * * * *